United States Patent [19]

Sakaki et al.

[11] Patent Number: 4,965,612

[45] Date of Patent: Oct. 23, 1990

[54] INK-JET RECORDING SYSTEM AND INK-JET RECORDING METHOD

[75] Inventors: Mamoru Sakaki, Sagamihara; Tomomi Nakatsugawa, Kawasaki; Shoji Koike; Hiroshi Sato, both of Yokohama, all of Japan

[73] Assignee: Canon Kabushiki Kaisha, Tokyo, Japan

[21] Appl. No.: 429,603

[22] Filed: Oct. 31, 1989

[30] Foreign Application Priority Data

Nov. 2, 1988 [JP] Japan ..... 63-277638
Nov. 2, 1988 [JP] Japan ..... 63-277639
Oct. 16, 1989 [JP] Japan ..... 1-269573

[51] Int. Cl.[5] ..... B41J 2/21

[52] U.S. Cl. ..... 346/1.1; 346/135.1; 346/140 R

[58] Field of Search ..... 346/1.1, 135.1, 140

[56] References Cited

U.S. PATENT DOCUMENTS 4,478,910 10/1984 Oshima et al. ..... 428/331
4,636,409 1/1987 Arai et al. ..... 427/256
4,636,410 1/1987 Akiya et al. ..... 427/261
4,758,461 7/1988 Akiya et al. ..... 428/212

FOREIGN PATENT DOCUMENTS 53012 4/1977 Japan .
120487 7/1982 Japan .
132586 8/1983 Japan .
35977 2/1984 Japan .

*Primary Examiner*—Joseph W. Hartary
*Attorney, Agent, or Firm*—Fitzpatrick, Cella, Harper & Scinto

[57] ABSTRACT

An ink-jet recording system comprising applying droplets of water-based inks of a yellow ink, a magenta ink, a cyan ink and a black ink onto a recording medium comprising a substrate paper having a surface layer comprising a pigment and a fibrous substance of the substrate paper which are present in a mixed state, and said recording medium having a Stockigt sizing degree ranging from 0 to 15 seconds, to carry out recording, wherein;

at least an ink with a dye concentration ranging from 2.5 to 4.5% by weight is used as said black ink; and the recording is carried out in a maximum ink-adhering quantity ranging from 14 nl/mm$^2$ to 20 nl/mm$^2$ and in a maximum print-overlap number ranging from 2 to 2.5, is provided.

22 Claims, No Drawings

INK-JET RECORDING SYSTEM AND INK-JET RECORDING METHOD

BACKGROUND OF THE INVENTION

1. Field of the Invention

The present invention relates to an ink-jet recording system, and an ink-jet recording method, employing a recording medium that has superior colorforming performance and ink absorption and also can be prepared at a low cost. It also relates to an ink-jet recording system, and an ink-jet recording method, that can give a recorded image with superior sharpness, optical density and quality level.

2. Related Background Art

Hitherto known recording mediums used for inkjet recording include;

(1) those comprising an ordinary paper mainly composed of pulp, so made as to have a low degree of sizing as in filter paper or blotting paper (for example, those disclosed in Japanese Patent Laid-Open No. 52-53012): and (2) those comprising a substrate and a coat provided thereon using a pigment such as silica or zeolite which is porous, has a large oil absorption, and is capable of absorbing coloring components contained in ink.

The above recording mediums (1) are available in a low cost and also have excellent ink absorption, but may soak up ink so deeply into the fibrous layer of paper that the color-forming performance of the coloring material becomes poor. A phenomenon called feathering may also occur because of the absorption of ink along the fiber at the surface of the paper, to cause the phenomenon that a dot cannot be round but becomes jagged or a dot becomes so excessively large as to lower the resolution. As a result, no image with good quality can be obtained, disadvantageously.

For this reason, paper of a non-coated type has been chiefly used for the purpose of monochromatic recording or in terminals of personal computers in which the resolution may be relatively low and images with high density may not necessarily be required.

In the above recording mediums (2), coated papers comprising a substrate paper made of paper having a relatively higher degree of sizing (e.g., commercially available wood free paper) have been hitherto used as reported, for example, in Japanese Patent Laid-Open Nos. 58-132586 and 59 35977. Such coated papers comprise an ink-absorbing layer which is porous and uniform, so that there can be achieved appropriate ink absorption and images obtained images with excellent dot forms, color-forming performance and resolution.

However, in a recording system that requires an image with a higher quality level and higher resolution, a larger quantity of ink must be absorbed and fixed at a high speed. In this instance, a measure has been hitherto taken such that the coating weight of the ink-absorbing layer is increased and the void volume at the coat serving as the ink-absorbing layer is made larger. With an increase in the thickness of the coat, however, the problem of so-called dusting (peeling off of pigments on a surface) may arise, in which the coat is peeled from the substrate paper when the recording medium comes into contact with a carrying system in a recording apparatus. The dust thus formed not only contaminates the inside of the apparatus but also may cause clogging of nozzles of ink-jet heads, and hence is particularly questioned.

Moreover, in the course of manufacture, a large quantity of coating solution must be so rapidly dried that the binder contained in the coating solution may undergo migration, greatly causing a lowering of the strength of the coat or a lowering of the ink absorption. Such problems may be solved to a certain extent by making drying conditions milder or, for example, carrying out the coating dividedly several times. This, however, may also cause the problem that a high production cost results.

Means for solving these problems may include a method in which a paper with a low degree of sizing is used as the substrate paper and a porous pigment layer is provided thereon. For example, U.S. Pat. No. 4,478,910 discloses a recording medium comprising a substrate paper having a degree of sizing, of not more than 4 seconds and provided thereon a coat containing a silica having specific physical properties.

The recording medium of this type has the advantage that a recording medium having a good ink absorption can be obtained even when a relatively thin ink-receiving layer is provided, or the advantage that the coat to be provided may be in a small coating weight and hence the burden of the manufacture can also be small, resulting in a low cost and less generation of the dust. Even such a recording medium, however, has the following problems: (i) Because of penetration of a large quantity of ink deep into the substrate paper, a low print density may result. (ii) Because of the thin ink-receiving layer, which can little retain the ink, the form of dots is worsened when the ink is absorbed in the substrate paper, as pointed out in the recording mediums (1) previously discussed, or the ink droplets thus adhered may excessively run on the paper, resulting in a lowering of the resolution and print quality level.

On the other hand, in highly detailed full color recording that can obtain an image with a photographic tone, ink is required to be applied in a large quantity so that a high image density can be achieved. Moreover, in order to express multiple color tones, printing must be carried out using color inks for yellow (Y), magenta (M) and cyan (C), at least two or three of which are overlapped.

In this instance, the recording medium as mentioned above, which is different from the recording medium of the type to absorb ink with only the ink-receiving layer (i.e., the ink does not penetrate into the substrate paper) as in the case of the recording mediums (2) previously mentioned, is a recording medium in which the substrate paper absorbs and retains a greater part of the ink (in particular, solvent). Hence, there is a problem that the substrate may be swollen with the ink solvent and shrunk when dried, to cause cockling, or that the ink may penetrate through the back side of the substrate paper to cause strike-through.

The problem of cockling or strike-through is a problem that can be solved if the paper thickness is made larger. An excessively large thickness, however, may bring about the problem that the hand of the paper greatly differs from that of so-called plain paper, or the problem that the paper becomes so highly stiff that difficulties may arise in carrying. Hence, such a recording medium is not preferred as a recording medium having general-purpose properties.

Thus, although the problems of the strike-through and cockling occurring when high-density recording is performed are problems peculiar to the paper of this type, no means for completely solving these problems has been hitherto known.

In addition, these problems are closely concerned with not only the recording medium but also with inks, recording methods and processes, etc., and therefore they should be solved from the viewpoint of each of the inks, recording mediums, and printing methods. No means, however, has been known which can solve them through such recording systems or processes.

SUMMARY OF THE INVENTION

Accordingly, an object of the present invention is to solve the above problems to provide an ink-jet color recording system, and an ink-jet recording method, capable of forming a highly detailed image with a high density and a wide color reproduction range, using a recording medium that has a rapid ink absorption even when a thin coat layer is provided, particularly has a superior dot form and is suited to form a highly detailed and sharp image, which recording medium is also a highly detailed image recording medium that may cause less dusting and can be prepared at relatively low cost.

Another object of the present invention is to provide an ink-jet color recording system, and an inkjet recording method, capable of forming an image with a high quality level, using a recording medium that may cause no strike-through and cockling.

The above objects can be achieved by the invention as described below.

In one aspect, the present invention is an inkjet recording system comprising applying droplets of water-based inks of a yellow ink, a magenta ink, a cyan ink and a black (Bk) ink onto a recording medium comprising a substrate paper having a surface layer comprising a pigment and a fibrous substance of the substrate paper which are present in a mixed state, and the recording medium having a Stöckigt sizing degree ranging from 0 to 15 seconds, to carry out recording, wherein;

at least an ink with a dye concentration ranging from 2.5 to 4.5% by weight is used as said black ink; and the recording is carried out in a maximum ink-adhering quantity ranging from 14 nl/mm$^2$ to 20 nl/mm$^2$ and in a maximum print-overlap number ranging from 2 to 2.5.

In a preferred embodiment of the above system, the present invention is an ink-jet recording system comprising applying droplets of water-based inks of a yellow ink, a magenta ink, a cyan ink and a black ink onto a recording medium comprising a substrate paper having a surface layer comprising a pigment and a fibrous substance of the substrate paper which are present in a mixed state, and the recording medium having a Stöckigt sizing degree ranging from 0 to 15 seconds, to carry out recording, wherein;

an ink containing from 2.5 to 4.5% by weight of a dye and from 1 to 40% by weight of a solvent having a surface tension of not less than 43 dyne/cm at 20° C. is used as said black ink; and the recording is carried out in a maximum ink-adhering quantity ranging from 14 nl/mm$^2$ to 20 nl/mm$^2$ and in a maximum print-overlap number ranging from 2 to 2.5.

In another aspect, the present invention is an ink-jet recording method comprising applying droplets of water-based inks of a yellow ink, a magenta ink, a cyan ink and a black ink onto a recording medium comprising a substrate paper having a surface layer comprising a pigment and a fibrous substance of the substrate paper which are present in a mixed state, and the recording medium having a Stöckigt sizing degree ranging from 0 to 15 seconds, to carry out recording, wherein;

at least an ink with a dye concentration ranging from 2.5 to 4.5% by weight is used as said black ink; and the recording is carried out by applying said droplets of inks onto said recording medium in a maximum ink-adhering quantity ranging from 14 nl/mm$^2$ to 20 nl/mm$^2$ and in a maximum print-overlap number ranging from 2 to 2.5.

In a preferred embodiment of the above method, the present invention is an ink-jet recording method comprising applying droplets of water-based inks of a yellow ink, a magenta ink, a cyan ink and a black ink onto a recording medium comprising a substrate paper having a surface layer comprising a pigment and a fibrous substance of the substrate paper which are present in a mixed state, and the recording medium having a Stöckigt sizing degree ranging from 0 to 15 seconds, to carry out recording, wherein;

an ink containing from 2.5 to 4.5% by weight of a dye and from 1 to 40% by weight of a solvent having a surface tension of not less than 43 dyne/cm at 20° C. is used as said black ink; and the recording is carried out by applying said droplets of inks onto said recording medium in a maximum ink-adhering quantity ranging from 14 nl/mm$^2$ to 20 nl/mm$^2$ and in a maximum print-overlap number ranging from 2 to 2.5.

DESCRIPTION OF THE PREFERRED EMBODIMENTS

As a recording medium used for ink-jet recording that records using a water-based ink, the present inventors have discovered that the recording medium mentioned in the above is a recording medium that may cause less generation of dust owing to dusting, has a high ink absorption, and can be provided at a relatively low cost. They further have discovered for the first time that a certain specific ink and a certain specific ink-applying method may be combined under use of such a recording medium, so that the problems such as cockling and strike-through, peculiar to the above recording medium, may not be caused even with use of such a recording medium, and an image particularly superior in optical density and sharpness can be provided. They thus have accomplished the present invention.

The "system" used in the present invention includes a system, in which a picture processing signal generation means and a printer are combined in one body like a copying machine, or a system, in which a picture processing signal from a host-computer is input to a printer and the picture is output by means of a printer, such as a combination of a host-computer and its terminal equipment, a printer.

The present invention will now be described below in greater detail by giving preferred embodiments.

At the outset, the recording medium used in the system and method of the present invention constitutes a liquid-absorptive substrate paper and a surface layer comprising a pigment and a fibrous substance of the substrate paper which are present in a mixed state. It does not matter whether the fibrous substance of the substrate paper is exposed to the surface. A suitable Stöckigt sizing degree according to JIS P-8122, of the recording medium may range from 0 to 15 seconds, preferably from 0 to 10 seconds, and more preferably from 0 to 8 seconds. In other words, the recording medium of the present invention is of the substrate paper type that the ink is mainly received and retained in the substrate paper, which is thus different from the recording mediums (2) previously mentioned. A degree of sizing more than 15 seconds, of the recording medium may result in a poor ink absorption, and the providing of a thick coat layer to overcome this disadvantage may cause the problem of dusting or other problems as involved in the recording mediums (2) previously mentioned.

The recording medium used in the system and method of the present invention may preferably have an air permeability of not more than 100 seconds according to JIS P-8117. Recording mediums having an air permeability of more than 100 seconds may have a poor ink absorption when the substrate paper has an air permeability of more than 100 seconds, causing the problem of bleeding at the boundary areas of prints (or print characters). The provision of the thick coat layer may also cause the problem as discussed in the above (2), when the air permeability is more than b 100 seconds.

The recording medium used in the system and method of the present invention may have a thickness according to JIS P- 8118, of from 90 to 140 μm, more preferably from 100 to b 130 μm, and still more preferably from 105 to 125 μm. In the recording medium used in the system and method of the present invention, in which the substrate paper absorbs ink, the strike-through or cockling tend to occur if its thickness is smaller, and hence the ink can not be applied in a large quantity, so that a sufficient image density can be obtained with difficulty as will be mentioned later. On the other hand, a thickness more than 140 μm may result in an excessively high stiffness of the recording medium to produce a problem in the carrying performance in the apparatus, also bringing about the problems that the hand is unlike a plain paper and also such a recording medium can not be used together with plain paper for reasons of apparatus.

In instances in which the recording medium as described above is used in a full-color high density recording, there are conflicting problems as follows:

(i) Because of the problem of strike-through or cockling, the ink cannot be adhered into the medium in the quantity more than a given amount.

(ii) In order to achieve a wide color reproduction range and form a depth-rich image, at least two or three colors of Y, M and C must be printed overlapping each other.

(iii) In the present circumstances, the improvement in an image density has been almost saturated in regard to the coated papers employing inorganic pigments such as silica. Hence, the image density depends only on the density of dyes applied on the recording medium in the case when print areas have been entirely filled, so that the dyes must be used in a correspondingly large quantity in order to obtain a high image density.

For these reasons, in order to form an image with a high density and high quality level, using the above recording medium without causing strike-through or cockling, it is necessary for the above correlated respective quantities to be each controlled in an appropriate range.

Namely, as a result of studies made by the present inventors, they have found the following: In order to make the density of a black image comparable to that obtained in an electrophotographic systems, the dye is required to be used at least in an amount not less than the amount corresponding to 240 ng/mm$^2$ to 280 ng/mm$^2$ as density, per unit area. This applies to the instance where ordinary silica is used as the pigment constituting the surface layer (i.e., ink-receiving layer).

On the other hand, they also have found that the tolerance in the amount of ink that can be adhered into the coated paper of the substrate paper absorption type as described above is about 20 nl/mm$^2$ at maximum substantially without regard to the type of ink; the printing in an amount more than 20 nl/mm$^2$ results in occurrence of the strike-through or cockling.

Maximum tolerance in the concentration of the dye in the ink serving as a recording solution is 4.5% by weight. In the case of the water-based ink, substantially without regard to the type and quantity of the solvent, a concentration, more than 4.5% by weight tends to cause a first-ejection difficulty (i.e, non-ejection of ink or ejection-disturbance, accompanying a viscosity increase caused by evaporation of the solvent in ink at the tip of an inkjet head nozzle) or clogging (i.e., nozzle clogging caused by deposition of dyes at the tip portion of a nozzle when the ink has been left open for a long period of time), and may further bring about the problem that the dyes tend to be deposited during storage.

The water-based ink which is the recording solution used in the system and method of the present invention is comprised of not less than 50% by weight of water contained as a solvent, where the solvent is mainly formed of water and a water-soluble organic solvent. It is suitable for the present invention that the water-soluble organic solvent is contained in the ink in an amount ranging at least from 1 to 40% by weight, preferably from 20 to 40% by weight, and more preferably from 25 to 40% by weight. In the water-based ink, a content less than 1% by weight of the solvent tends to cause a first-ejection difficulty (i.e., non-ejection of ink or ejection-disturbance, accompanying a viscosity increase caused by evaporation of the solvent in ink at the tip of an ink-jet head nozzle) or clogging (i.e., nozzle clogging caused by deposition of dyes at the tip portion of a nozzle when the ink has been left open for a long period of time). On the other hand, since in the recording medium used in the system and method of the present invention the substrate paper absorbs ink, a content more than 40% by weight of the solvent tends to cause the strike-through or cockling.

As a more preferred embodiment of the present invention, the recording solution employs as the solvent a solvent having a surface tension of not less than 43 dyne/cm at 20° C. The solvent to be used may preferably include, for example, ethylene glycol, diethylene glycol, triethylene glycol, glycerol, and thiodiglycol. A solvent with a lower surface tension and viscosity may cause the ink to excessively penetrate into the recording medium such that strike-through or cockling tends to occur. For example, this occurs when ethanol, methanol, N-methyl-2-pyrrolidone, 1,3-dimethyl-2-imidazolidinone, triethylene glycol monomethyl ether, or the like is used. In the present invention, it is preferred for these solvents not to be used at all, or, even when used, to be used in the range of less than 20% by weight, and more preferably less than 5% by weight. Use thereof in an amount not less than 20% by weight causes strike-through or cockling tend to occur.

As described above, in order to obtain the dye density in the amount corresponding to 280 ng/mm$^2$, using the ink in the critical dye concentration of 4.5% by weight, it is required for the ink to be applied in an amount of 7.2 nl/mm$^2$ per a single color of the black. If here are used all the Y, M, C and Bk under the same ejection conditions, there is the possibility that the ink-adhering quantity comes to be more than 20 nl/mm$^2$ when printing is carried out in a print-overlap number of more than 2.5, and, when this turns to the case, the strike-through or cockling occurs.

Since the print-overlap number necessary for the reproduction of all colors is not less than 2.0 when the UCR (under-color removal) process is hundred-percent used, the print-overlap number essential in the present invention is from 2 to 2.5.

On the other hand, in order to achieve the dye density of 240 ng/mm$^2$, a maximum ink-adhering quantity is required to be 14 nl/mm$^2$ (6.2 nl/mm$^2$ as a preset value of the single color) even when the ink with a dye concentration of 4.5% by weight is used and the maximum print-overlap number is made to be 2.0. It follows from the foregoing that in the present invention the essential maximum ink-adhering quantity ranges from 14 to 20 nl/mm$^2$.

In addition, since the dye concentration of 240 nl/mm$^2$ cannot be achieved unless an ink with a dye concentration of not less than 2.5% by weight is used when the print-overlap number is 2.0 and the maximum ink-adhering quantity is 20 nl/mm$^2$. Thus, in the present invention, the essential dye concentration ranges from 2.5 to 4.5% by weight.

As in the above, there arise the problems that a print-overlap number less than 2 may cause a decrease in the color reproduction range, and also a maximum ink-adhering quantity less than 14 nl/mm$^2$, e.g., 9.4 nl/mm$^2$ as disclosed in Japanese Patent Laid-Open No. 57-120487, and a dye concentration less than 2.5% by weight cannot bring about the simultaneous achievement of both the prevention of strike-through or cockling and the desired image density even if any combinations are used.

The print-overlap number mentioned in the present invention refers to an average value per dot, of the number of ink droplets which are shot into the recording medium, per one picture element (or unit area).

In the reading and reproduction of color images, Y, M and C signals, the image signals obtained by the reading from an original, are computer processed and then, based on the resulting signals, reproduced as a visible image on a recording medium such as paper, using Y, M and C inks. Thus, the color to be reproduced depends on the ratios of Y, M and C inks having been shot into the recording medium, per one picture element.

According to the subtractive color process, Bk is expressed as a mixed color of Y, M and C, and therefore the maximum print-overlap number in the full-color recording is usually 3. However, the employment of the UCR (under-color removal) process enables replacement of each Y, M and C with a Bk image signal, corresponding to the portion obtained by multiplying the ratios at minimum values of the Y, M and C image signals, so that the Y, M and C inks in given quantities can be replaced with the Bk ink and thus the maximum print-overlap number can be decreased.

The greater the multiplying ratios (the image processing constants are made in the UCR process, as described above, the more the print-overlap number can be decreased. The maximum print-overlap number at the time the ratios are 100% is 2.0. A number less than this results in no achievement of any color reproduction. In the present invention, the maximum print-overlap number can be brought into the desired range by adjusting UCR quantities, of course, an excessive application of UCR may bring about a lowering of the chroma at a low-density area, it is preferred for the print-overlap number to be so set as to become larger so long as the object of the present invention can be achieved. Incidentally, the UCR process itself is known in the art in the field of common printing and so forth.

The maximum ink-adhering quantity mentioned in the present invention refers to the amount of ink adhered per unit area when recording is carried out in the above maximum print-overlap number, and can be determined by measuring the amount of ink consumed when the recording is carried out in the above maximum print-overlap number and the area on which a print is actually made. In the present invention, the maximum ink-adhering quantity can be controlled on the bases of the volume of droplets ejected from head nozzles and the maximum print-overlap number.

In the system and method of the present invention, it is the coated paper employing usual silica or the like, as previously described, that can achieve the image density comparable to that of electrophotographic recording, at the dye adhesion density of from 240 to 280 ng/mm2 of course, even with employment of the recording system and method of the present invention, it follows that such image density cannot be achieved for reasons of the system itself if papers having a poorer color-forming performance (as exemplified by the non-coated paper as in the recording mediums (1) previously discussed) are used. In these recording mediums, however, it is needless to say that carrying out the recording as recording within the scope of the system and method of the present invention can achieve the maximum image density obtained when the respective recording mediums are used, and also neither strike-through nor cockling may occur.

In the system and method of the present invention, it is required for at least the Bk ink to achieve the dye concentration of from 2.5 to 4.5% by weight. It, however, is of course preferred also for the inks of Y, M and C colors to have achieved the above dye concentration. According to the discovery by the present inventors, at least only the Bk ink is required to be so controlled as to be used within the scope of the present invention, because the Bk ink is much poorer than other inks in view of the first-ejection performance, fixing performance and shelf stability of the ink and also the color-forming performance on the recording medium.

In the present invention, the dye used in the black ink includes commonly available water-soluble dyes, namely, acid dyes, basic dyes, direct dyes, and food colors, any of which can be used.

There are no particular limitations on the pulp that constitutes the substrate paper serving as a substrate of the recording medium used in the system and method of the present invention. Conventionally known wood pulp as typified by LBKP or NBKP is mainly used, but synthetic fiber or glass fiber also may be optionally mixed.

Examples of loading materials for the substrate paper used in the present invention include clay, talc, kaolinite, titanium oxide, and calcium carbonate, which are commonly used. In particular, in the present invention, these loading materials are contained in an amount ranging from 2 to 15%, and preferably from 4 to 10%, in terms of the ash content according to JIS P-8128.

According to the discovery by the present inventors, in particular, the spread or dot form of the ink droplets adhered on the recording medium is greatly affected by the ash content of the substrate paper when the paper of this type is used. An ash content less than 2% may cause a great spread of the adhered ink droplets in the direction of the fiber on the substrate paper surface, resulting in a poor dot form and an unnecessarily greater spread of ink droplets (i.e., feathering). On the other hand, an ash content more than 15% may result in loss of stiffness and besides occurrence of the dusting from the substrate paper, undesirably. Of the above loading materials, calcium carbonate is preferred since it brings about a particularly good dot form and color-forming performance.

The substrate paper used in the present invention is made by using the above materials optionally together with conventionally known paper-making auxiliaries, sizing agents, yield-improving agents, paper reinforcing agents, and so forth.

In the present invention, for the purpose of reinforcing the strength, the smoothness, the water resistance, etc. of the surface of the substrate paper, surface size pressing may be further carried out using conventionally known sizing agents such as starch, starch oxide, and polyvinyl alcohol.

The substrate paper thus prepared may preferably have a Stöckigt sizing degree ranging from 0 to 15 seconds, and more preferably ranging from 0 to 10 seconds. Use of a substrate paper having a degree more than 15 seconds may result in a lowering of ink absorption, undesirably. The substrate paper may also preferably have an air permeability within the range of not more than 90 seconds. A substrate paper with an air permeability of more than 90 seconds may have less void volume inside the substrate paper, resulting in a lowering of ink absorption.

In the recording medium of the system and method of the present invention, the ink-receiving layer provided on the above substrate paper is comprised of a pigment and a hydrophilic binder.

The pigment includes conventionally known inorganic pigments such as finely powdered silicic acid, clay, talc, calcium carbonate, calcium sulfate, barium sulfate, titanium oxide, zinc oxide, alumina, satin white, aluminum silicate, and lithopone; and organic pigments such as urea resin particles. Of these, it is particularly preferred to use silica (finely powdered silicic acid) or alumina since the color-forming performance can be improved.

The hydrophilic binder usable in the present invention includes water-soluble polymers and derivatives thereof such as starch, cationic starch, gelatin, gum arabic, sodium alginate, cellulose derivatives such as carboxymethyl cellulose and hydroxyethyl cellulose, polyvinyl alcohol, polyvinyl pyrrolidone, sodium polyacrylate, and other acrylic resins; and water dispersion polymers such as SBR latex, MBR latex, vinyl acetate emulsions, and acrylic emulsions. Such, binder may preferably have a molecular weight of not less than 500, and more preferably from not less than 1,000.

The pigment previously described and the foregoing binder may be used in a proportion of from $\frac{1}{3}$ to 5/1, and preferably from $\frac{1}{2}$ to 3/1, in weight ratio. Use of the binder in the proportion more than $\frac{1}{3}$ may result in a lowering of the porocity of the ink-receiving layer, which lowers the ink absorption, so that there may arise the problem of so-called beading in which the ink adhered on the surface is flowed out before absorbed into the ink-receiving layer and comes into contact with adjacent dots to give print unevenness. On the other hand, use of the binder in the proportion less than 5/1 may cause serious dusting from the ink-receiving layer, undesirably.

In the present invention, the ink-receiving layer may optionally be further incorporated with dye fixing agents (later resistance imparting agents), fluorescent brighteners, surface active agents, anti-foaming agents, pH adjusters, mildewproofing agents, ultraviolet absorbents, antioxidants, etc.

In the system and method of the present invention, the above ink-receiving layer may preferably be provided on the substrate in a dried coating weight of from 0.5 to 10 g/cm$^2$, and more preferably from 1 to 8 g/cm$^2$. A coating weight of less than 0.5 g/cm$^2$ cannot give any particular effect compared with the case when the ink-receiving layer is not provided. On the other hand, an ink-receiving layer provided in a coating weight more than 10 g/cm$^2$ may bring about the problem of dust caused by dusting as in the recording mediums (2) previously mentioned, or the problem of high production cost.

As in the above, in the recording medium used in the system and method Of the present invention, the pigment contained in both the substrate paper and ink-receiving layer is one of the factors that influence the ink absorption. Thus, it is preferred for the recording medium used in the system and method of the present invention to have a total ash content, which is determined by measurement according to JIS P-8128 as previously described, of from 2 to 18% by weight, and preferably from 4 to 15% by weight.

A total ash content less than 2% by weight may bring about an excessively low ink absorption for both the ink-receiving layer and substrate paper, cause bleeding and feathering, and result in a lowering of the print quality level. A total ash content more than 18% by weight may also bring about the problem of dusting because of a lowering of the strength of the coat layer, or, in respect of the substrate paper, the problem of a low stiffness of the paper and a difficulty in the carrying performance inside the apparatus.

In preparing the recording medium of the present invention, a coating solution containing the components as described above is applied on the substrate surface according to any known methods as exemplified by roll coating, blade coating, air-knife coating, gate roll coating, and size pressing.

After the water-based coating solution comprising the pigment and binder has been coated on the substrate, drying is carried out using, for example, a hot-wind drying furnace or a heated drum. The recording medium of the present invention can be thus obtained. A supercalender may also be used in order to smooth the surface of the ink-receiving layer, or in order to increase the surface strength of the ink-receiving layer.

The system and method of the present invention are the recording system and method in which the above recording medium is used. In this recording system or method, the ink itself, applied onto the above-described particular recording medium according to ink-jet recording, may be the one known in the art. For example, the recording agent thereof may be a water-soluble dye as typified by a direct dye, an acid dye, a basic dye, a reactive dye, and a food color. The ink preferably includes inks suitable particularly as inks for ink-jet recording systems and capable of giving images that can satisfy the fixing performance, color-forming performance, sharpness, stability, light-resistance and other required performances when used in combination with the above recording medium.

The solvent used in the water-based ink used in the present invention comprises water or a mixed solvent of water and water-soluble organic solvent. Particularly preferred is the mixed solvent of water and water-soluble organic solvent, which contains as the water-soluble organic solvent a polyhydric alcohol having the effect of preventing the ink from drying or a derivative thereof. As the solvent, it is preferred to use at least one kind of solvent having a surface tension of not less than 43 dyne/cm at 20° C. so that the strike-through or cockling may not occur owing to over-penetration. As water, it is also preferred to use deionized water rather than common water containing various ions.

The ink used in the present invention may also optionally contain surface active agents viscosity modifiers, and surface tension modifiers, in addition to the components described above.

In the system and method of the present invention, the ink-jet recording to carry out the recording by applying the above ink onto the recording medium previously described may be of any method so long as it is a method that can effectively release the ink from nozzles and apply the ink onto the target recording medium.

The present invention can effect the following:

(a) The system and method of the present invention employ a recording medium comprising the ink-receiving layer containing a large quantity of the pigment highly capable of capturing the dye, so that the dye in ink droplets can be captured and absorbed in the pigment at high probability. Hence, the spread and diffusion of ink are suppressed and consequently the dot form can be improved to give a superior ink absorption, resolution, color-forming performance and color-forming density.

(b) The recording medium used in the system and method of the present invention has an excellent ink absorption of the substrate itself, and a dot form. Hence it has good performance of the above (a), may not contaminate the inside of the recording apparatus, may cause less generation of the dust that may bring about clogging of nozzles, and can be provided at a low cost.

(c) Moreover, in the system and method of the present invention, the correlated factors, i.e., the dye concentration in ink, the maximum print-overlap number and the maximum ink-adhering quantity, are set within the specific ranges. Hence, it has become possible to achieve at the same time the following conflicting two objects;

(i) to prevent the strike-through or cockling when using the paper of the substrate paper absorption type as described in the above; and (ii) to provide the image having a high image density and a wide color reproduction range.

EXAMPLES

The present invention will be described below in greater detail by giving examples and comparative examples. In the following, "part(s)⇄ or "%" is by weight unless particularly mentioned.

Preparation of recording medium (A) Using 95 parts of LBKP having a freeness (C.S.F.) of 370 ml and 5 parts of NBKP having a freeness (C.S.F.) of 370 ml as low material pulp, calcium carbonate (trade name: Escalon #2000; a product of Sankyo Seifun K.K.) as loading materials, a neutral sizing agent (A.K.D.; a product of Dick Hercules) and cationized starch were mixed therein. Substrate paper A with an ash content of 6 % and a low degree of sizing was thus obtained.

The Stöckigt sizing degree of the substrate paper A was measured to be less than 1 second.

On the above substrate paper A, the following coating composition was applied by bar coating so as to give a dried coating weight of 3% g/m$^2$, which was then dried at 110° C. for 5 minutes, followed by treatment with a test supercalender, under a linear pressure of 50 kg/cm. Recording medium i was thus prepared. The recording medium 1 was confirmed to be a recording medium having a Stöckigt sizing degree of 1 second, a thickness of 12μm and an air permeability of 65% seconds. Measurement was in accordance with the method previously described.

| Coating composition: | |
|---|---|
| Finely divided alumina (Aerosil Aluminum Oxide C; a product of Degussa Co., Ltd.) | 10 parts |
| Polyvinyl alcohol (PVA-110; a product of Kuraray Co., Ltd.) | 5 parts |
| Water | 85 parts |

Preparation of recording medium 2

(B) Using as low material pulp the same materials as used in the substrate paper A calcium carbonate (Escalon #2000; a product of Sankyo Seifun K.K.)as loading materials, a neutral sizing agent (A.K.D ), cationized starch and an acrylamide resin (trade name: X Coat P-130C; a product of Seiko Chemical Co., Ltd.) were mixed therein. Substrate paper B with an ash content of 9% and a low degree of sizing was thus obtained.

The Stöckigt sizing degree of the substrate paper B was measured to be 3 seconds.

On the above substrate paper B, the following coating composition was applied by bar coating so as to give a dried coating weight of 6 g/m$^2$, which was then dried at 110° C. for 5 minutes, followed by treatment with a test supercalender under a linear pressure of 50 kg/cm. Recording medium 2 was thus prepared.

The recording medium 2 was confirmed to be a recording medium having a Stöckigt sizing degree of 4 second, a thickness of 110 μm and an air permeability of 57 seconds. Similarly, the measurement was in accordance with the method previously described.

| Coating composition: | |
|---|---|
| Finely divided alumina (Finesil X-37; a product of Tokuyama Soda Co., Ltd.) | 10 parts |
| Polyvinyl alcohol (PVA-110; a product of Kuraray Co., Ltd.) | 5 parts |
| Water | 85 parts |

The following ink was prepared as a recording solution to make a record on the above recording medium.

| Bk ink: | |
|---|---|
| C.I. Food Black 2 | x parts |
| Diethylene glycol | 30 parts |
| Water | (70 − x) parts |

Using a recording apparatus of a bubble-jet system, mounting 4 sets of ink-jet recording heads each having 128 lines of nozzles at intervals of 15.7 lines per 1 mm, recording was carried out on the above recording medium. The temperature of these recording heads was controlled by means of an external heater so as to be in three stages of 30° C., 35° C. and 45° C., and Bk-ink single-color solid printing was carried out to determine the ink-adhering quantity at the time of the solid printing, from each quantity of ink consumption, and the average diameter of the droplets ejected from each case . Results obtained are shown in Table 1.

TABLE 1

| Recording method | Head temperature | Ink-adhering quantity (single color) | Average droplet diameter |
|---|---|---|---|
| (1) | 30° C. | 5.6 nl/mm$^2$ | 35 μm |
| (2) | 35° C. | 7.8 nl/mm$^2$ | 39 μm |
| (3) | 45° C. | 9.5 nl/mm$^2$ | 42 μm |

In the respective recording methods (1) to (3) carried out using the above recording apparatus, like images (solid prints) each giving a maximum print-overlap number of 2.0, 2.3 or 2.7 were printed on the recording mediums 1 and 2, and the degree of strike-through at maximum print-overlap areas was evaluated.

Used as Y, M and C inks were those each having the same composition as that of the above Bk ink except for use of the following as dyes. The inks used were all made to have a dye concentration of 3% (x=3).

Y ink: C.I. Direct Yellow 86

M ink: C.I. Acid Red 35

C ink: C.I. Direct Blue 86

The strike through was evaluated by measuring the image density (O.D.), using a Macbeth densitometer RD-918. The O.D. value was obtained by subtracting the O.D. value at white ground areas of the recording medium, and the value thus obtained was indicated as a strike-through O.D. value.

As evaluation on the strike-through, organoleptic evaluation based on visual observation was also made at the same time. An instance where no strike-through was visually recognized was evaluated as A; an instance where clear strike-through was visually seen, as C; and an instance where partial dot-like strike-through is recognized, as B.

Results obtained in the above are shown in Table 2.

TABLE 2

| Recording method | Maximum print-overlap number | Maximum ink-adhering quantity nl/mm$^2$ | Strike-through: Recording medium 1 O.D. | Recording medium 1 V.O.* | Recording medium 2 O.D. | Recording medium 2 V.O.* |
|---|---|---|---|---|---|---|
| (1) | 2.0 | 11.2 | 0.10 | A | 0.10 | A |
| | 2.3 | 12.9 | 0.10 | A | 0.10 | A |
| | 2.7 | 15.1 | 0.11 | A | 0.11 | A |
| (2) | 2.0 | 15.6 | 0.11 | A | 0.11 | A |
| | 2.3 | 17.9 | 0.11 | A | 0.13 | A |
| | 2.7 | 21.1 | 0.18 | C | 0.42 | C |
| (3) | 2.0 | 19.0 | 0.11 | A | 0.14 | B |
| | 2.3 | 21.9 | 0.20 | C | 0.44 | C |
| | 2.7 | 25.7 | 0.23 | C | 0.56 | C |

*Visual observation

Next, using each Bk ink made to be x=1.5, 3, 4 or 5, Bk single-color solid printing was carried out on the recording mediums 1 and 2 each, in respect of the above recording methods (1) to (3). The O.D. at the printed areas was similarly measured using the Macbeth densitometer RD-918.

First-ejection performance was also evaluated on the printing carried out using the above recording apparatus under environment of 150° C. and 10% RH and also using Bk ink of x=1.5, 3, 4 or 5. Evaluation was made by confirming the state of ejection when printing was started without carrying out restoration after the tips of head nozzles were left open for 1.5 minutes under the like environment.

Here, an instance where normal printing was effected was evaluated as A; an instance where prints blurred because of non-ejection at the beginning of printing, as C.

Results of the evaluation on O.D. and first-ejection performance are shown together in Table 3.

TABLE 3

| Recording method | Dye density of ink (x) | O.D.: Recording medium 1 | O.D.: Recording medium 2 | Overall evaluation | First-ejection performance |
|---|---|---|---|---|---|
| (1) | 1.5% | 0.84 | 0.96 | C | A |
| | 3 | 1.08 | 1.19 | C | A |
| | 4 | 1.20 | 1.30 | C | A |
| | 5 | 1.38 | 1.48 | A | C |
| (2) | 1.5% | 0.97 | 1.05 | C | A |
| | 3 | 1.35 | 1.40 | A | A |
| | 4 | 1.45 | 1.47 | A | A |
| | 5 | 1.53 | 1.53 | A | C |
| (3) | 1.5% | 1.05 | 1.12 | C | A |
| | 3 | 1.44 | 1.51 | A | A |
| | 4 | 1.52 | 1.52 | A | A |
| | 5 | 1.55 | 1.55 | A | C |

Images with an O.D. of 1.35 or more have the same level as those obtained by electrophotography.

As a preferred embodiment of the present invention, an example is further shown below in which the amount and type of the solvent in the recording solution are varied.

The following ink was prepared as a recording solution to make a record on the above recording medium.

| Bk ink: | |
|---|---|
| C.I. Food Black 2 | 3 parts |
| Diethylene glycol | x parts |
| Water | (97 − x) parts |

In the respective recording methods (2) and (3) carried out using the above recording apparatus, like images (solid prints) each giving a maximum print-overlap number of 2.0 were printed on the recording mediums 1 and 2, using each Bk ink, in which x is 10 and 35, and the degree of strike-through at maximum print-overlap areas and the first-ejection performance was evaluated. Results obtained are shown in Table 4.

TABLE 4

| Recording method | Maximum ink-adhering quantity | Solvent content wt. (%) | Strike-through: Recording medium 1 O.D. | Recording medium 1 V.O.* | Recording medium 2 O.D. | Recording medium 2 V.O.* | First ejection performance |
|---|---|---|---|---|---|---|---|
| (2) | 15.6 nl/mm² | 10 | 0.10 | A | 0.10 | A | A |
| | | 35 | 0.11 | A | 0.11 | A | A |
| (3) | 19.0 nl/mm² | 10 | 0.11 | A | 0.11 | A | A |
| | | 35 | 0.11 | A | 0.14 | A | A |

*Visual observation

The following ink was prepared as a recording solution to make a record on the above recording medium.

| Bk ink: | |
|---|---|
| C.I. Food Black 2 | 3 parts |
| Solvent | 30 parts |
| Water | 67 parts |

Using Bk ink in which a solvent having a surface tension of not less than 43 dyne/cm at 20° C. was used, the above recording method (3) was carried out on the recording mediums 1 and 2. The degree of strike-through at areas of print-overlap number of 2, and the first-ejection performance were evaluated.

Results thus obtained are shown in Table 5.

TABLE 5

Recording method: (3)
Maximum ink-adhering quantity: 19.0 nl/mm²

| Type of solvent | Surface tension as solvent (20° C.) dyne/cm | Strike-through: Recording medium 1 O.D. | Recording medium 1 V.O.* | Recording medium 2 O.D. | Recording medium 2 V.O.* | First ejection performance |
|---|---|---|---|---|---|---|
| Ethylene glycol | 46.5 | 0.10 | A | 0.12 | A | A |
| Glycerol | 63.3 | 0.11 | A | 0.13 | A | A |
| Triethylene glycol | 45.2 | 0.09 | A | 0.13 | A | A |
| Thiodiglycol | 52.0 | 0.10 | A | 0.13 | A | A |

Overall evaluation on the above results are summarized in Table 6. In Table 6, results in the frames belong to the examples of the present invention.

TABLE 6

(Overall evaluation)

| Recording method | | Maximum print-overlap number 2.0 | 2.3 | 2.7 |
|---|---|---|---|---|
| (1)* | Maximum ink-adhering quantity: | 11.2 nl/mm² | 12.9 nl/mm² | 15.1 nl/mm² |

TABLE 6-continued (Overall evaluation)

| Recording method | | Maximum print-overlap number 2.0 | 2.3 | 2.7 |
|---|---|---|---|---|
| Dye concentration of ink: | 1.5% | x | | |
| | 3 | x | x | x |
| | 4 | x | | |
| | 5 | x | | |
| (2)** | Maximum ink-adhering quantity: | 15.6 nl/mm² | 17.9 nl/mm² | 21.1 nl/mm² |
| Dye concentration of ink: | 1.5% | x | | |
| | 3 | o | o | x |
| | 4 | o | | |
| | 5 | x | | |
| (3)*** | Maximum ink-adhering quantity: | 19.0 nl/mm² | 21.9 nl/mm² | 25.7 nl/mm² |
| Dye concentration of ink: | 1.5% | x | | |
| | 3 | o | x | x |
| | 4 | o | | |
| | 5 | x | | |

*Single-color adhering quantity: 5.6 nl/mm²
Droplet diameter: 35 μm
**Single-color adhering quantity: 7.8 nl/mm²
Droplet diameter: 39 μm
***Single-color adhering quantity: 9.5 nl/mm²
Droplet diameter: 42 μm

What is claimed is:

1. An ink-jet recording system comprising applying droplets of water-based inks of a yellow ink, a magenta ink, a cyan ink and a black ink onto a recording medium comprising a substrate paper having a surface layer comprising a pigment and a fibrous substance of the substrate paper which are present in a mixed state, and said recording medium having a Stöckigt sizing degree ranging from 0 to 15 seconds, to carry out recording, wherein:

at least an ink with a dye concentration ranging from 2.5 to 4.5% by weight is used as said black ink; and the recording is carried out in a maximum ink-adhering quantity ranging from 14 nl/mm² to 20 nl/mm² and in a maximum print-overlap number ranging from 2 to 2.5.

2. An ink-jet recording system according to claim 1, wherein said recording medium has a thickness ranging from 90 to 140 μm.

3. An ink-jet recording system according to claim 1, wherein said recording medium has an air permeability of not more than 100 seconds.

4. An ink-jet recording system according to claim 1, wherein said recording medium has a total ash content ranging from 2 to 18% by weight.

5. An ink-jet recording system according to claim 1, wherein the surface layer of said recording medium contains particles of silica and/or alumina.

6. An ink-jet recording system comprising applying droplets of water-based inks of a yellow ink, a magenta ink, a cyan ink and a black ink onto a recording medium comprising a substrate paper having a surface layer comprising a pigment and a fibrous substance of the substrate paper which are present in a mixed state, and said recording medium having a Stöckigt sizing degree ranging from 0 to 15 seconds, to carry out recording, wherein;

an ink containing from 2.5 to 4.5% by weight of a dye and from 1 to 40% by weight of a solvent having a surface tension of not less than 43 dyne/cm at 20° C. is used as said black ink; and the recording is carried out in a maximum ink-adhering quantity ranging from 14 nl/mm$^2$ to 20 nl/mm$^2$ and in a maximum print-overlap number ranging from 2 to 2.5.

7. An ink-jet recording system according to claim 1, wherein said solvent is at least one organic solvent selected from the group consisting of ethylene glycol, diethylene glycol, triethylene glycol, glycerol, and thiodiglycol.

8. An ink-jet recording system according to claim 6, wherein said recording medium has a thickness ranging from 90 to 1 40μm.

9. An ink-jet recording system according to claim 6, wherein said recording medium has an air permeability of not more than 100 seconds.

10. An ink-jet recording system according to claim 6, wherein said recording medium bas a total ash content ranging from 2 to 18% by weight.

11. An ink-jet recording system according to claim 6, wherein the surface layer of said recording medium contains particles of silica.

12. An ink-jet recording method comprising applying droplets of water-based inks of a yellow ink, a magenta ink, a cyan ink and a black ink onto a recording medium comprising a substrate paper having a surface layer comprising a pigment and a fibrous substance of the substrate paper which are present in a mixed state, and said recording medium having a Stöckigt sizing degree ranging from 0 to 15 seconds, to carry out recording, wherein;

at least an ink with a dye concentration ranging from 2.5 to 4.5% by weight is used as said black ink: and the recording is carried out by applying said droplets of inks onto said recording medium in a maximum ink-adhering quantity ranging from 14 nl/mm$^2$ to 20 nl/mm$^2$ and in a maximum print-overlap number ranging from 2 to 2.5.

13. An ink-jet recording system according to claim 12, wherein said recording medium has a thickness ranging from 90 to 140μm.

14. An ink-jet recording system according to claim 12, wherein said recording medium has an air permeability of not more than 100 seconds.

15. An ink-jet recording system according to claim 12, wherein said recording medium has a total ash content ranging from 2 to 18% by weight.

16. An ink-jet recording system according to claim 12, wherein the surface layer of said recording medium contains particles of silica and/or alumina.

17. An ink-jet recording method comprising applying droplets of water-based inks of a yellow ink, a magenta ink, a cyan ink and a black ink onto a recording medium comprising a substrate paper having a surface layer comprising a pigment and a fibrous substance of the substrate paper which are present in a mixed state, and said recording medium having a Stöckigt sizing degree ranging from 0 to 15 seconds, to carry out recording, wherein:

an ink containing from 2.5 to 4.5% by weight of a dye and from 1 to 40% by weight of a solvent having a surface tension of not less than 43 dyne/cm at 20° C. is used as said black ink; and the recording is carried out by applying said droplets of inks onto said recording medium in a maximum ink-adhering quantity ranging from 14 nl/mm$^2$ to 20 nl/mm$^2$ and in a maximum print-overlap number ranging from 2 to 2.5.

18. An ink-jet recording method according to claim 17, wherein said solvent is at least one organic solvent selected from the group consisting of ethylene glycol, diethylene glycol, triethylene glycol, glycerol, and thiodiglycol.

19. An ink-jet recording method according to claim 17, wherein said recording medium has a thickness ranging from 90 to 140μm.

20. An ink-jet recording method according to claim 17, wherein said recording medium has an air permeability of not more than 100 seconds.

21. An ink-jet recording method according to claim 17, wherein said recording medium has a total ash content ranging from 2 to 18% by weight.

22. An ink-jet recording method according to claim 17, wherein the surface layer of said recording medium contains particles of silica nd/or alumina.

* * * * *

UNITED STATES PATENT AND TRADEMARK OFFICE

CERTIFICATE OF CORRECTION

PATENT NO. : 4,965,612

DATED : October 23, 1990

INVENTOR(S) : Mamoru Sakaki et al.

It is certified that error appears in the above-identified patent and that said Letters Patent is hereby corrected as shown below:

COLUMN 1:

Line 38, "purpose" should read --purposes--.

Line 47, "59 35977" should read --59-35977--.

Line 50, "images" (second occurrence) should be deleted.

COLUMN 3:

Line 22, "inkjet" should read --ink-jet--.

Line 28, "inkjet" should read --ink-jet--.

COLUMN 5:

Line 21, "b" should be deleted.

COLUMN 6:

Line 17, "concentration," should read --concentration of--.

COLUMN 7:

Line 65, "constants" should read --constants)--.

UNITED STATES PATENT AND TRADEMARK OFFICE

CERTIFICATE OF CORRECTION

PATENT NO. : 4,965,612

DATED : October 23, 1990

INVENTOR(S) : Mamoru Sakaki et al.

It is certified that error appears in the above-identified patent and that said Letters Patent is hereby corrected as shown below:

COLUMN 8:

Line 4, "quantities, of" should read --quantities. Of--.

Line 27, "ng/mm2 of course," should read --ng/mm$^2$. Of course,--.

COLUMN 10:

Line 28, "Of" should read --of--.

COLUMN 11:

Line 67, ""part(s)⇄ " should read --"part(s)"

COLUMN 12:

Line 1, "medium" should read --medium 1--.

Line 16, "3%g/m$^{2,}$" should read --3 g/m$^2$,--.

UNITED STATES PATENT AND TRADEMARK OFFICE

CERTIFICATE OF CORRECTION

PATENT NO. : 4,965,612

DATED : October 23, 1990

INVENTOR(S) : Mamoru Sakaki et al.

It is certified that error appears in the above-identified patent and that said Letters Patent is hereby corrected as shown below:

Line 19, "Recording medium i" should read --Recording medium 1--.

Line 22, "12 μm" should read --121 μm--, and "65%" should read --65--.

Line 57, "second" should read --seconds--.

COLUMN 13:

Line 21, "case" should read --case.--.

Line 22, ". Results" should read --Results--.

UNITED STATES PATENT AND TRADEMARK OFFICE

CERTIFICATE OF CORRECTION

PATENT NO. : 4,965,612

DATED : October 23, 1990

INVENTOR(S) : Mamoru Sakaki et al.

It is certified that error appears in the above-identified patent and that said Letters Patent is hereby corrected as shown below:

COLUMN 17:

Line 20, "1 40 μm" should read --140 μm--.

Line 26, "bas" should read --has--.

Line 42, "ink:" should read --ink;--.

COLUMN 18:

Line 47, "nd/or" should read --and/or--.

Signed and Sealed this

Twenty-third Day of June, 1992

*Attest:*

DOUGLAS B. COMER

*Attesting Officer*

*Acting Commissioner of Patents and Trademarks*